US006018979A

United States Patent [19]

Davis

[11] Patent Number: 6,018,979

[45] Date of Patent: Feb. 1, 2000

[54] TOOL WORKING HEIGHT ADJUSTMENT FOR PRESS BRAKE

[75] Inventor: Stephen B. Davis, Rochester, N.Y.

[73] Assignee: Acro Industries, Inc., Rochester, N.Y.

[21] Appl. No.: 09/111,677

[22] Filed: Jul. 8, 1998

[51] Int. Cl.[7] ..... B21D 37/04

[52] U.S. Cl. ..... 72/482.4; 72/389.4; 72/446; 72/481.1

[58] Field of Search ..... 72/441, 442, 446, 72/447, 448, 481.1, 389.4, 389.5, 482.4; 100/257

[56] References Cited

U.S. PATENT DOCUMENTS

| | | | |
|---|---|---|---|
| 3,587,286 | 6/1971 | Fritsch . | |
| 3,844,156 | 10/1974 | Hanni et al. . | |
| 3,965,721 | 6/1976 | Roch . | |
| 4,106,323 | 8/1978 | Haenni et al. . | |
| 4,354,374 | 10/1982 | Deguchi | 72/389.5 |
| 4,426,873 | 1/1984 | Pearson et al. . | |
| 4,653,307 | 3/1987 | Zbornik . | |
| 4,732,032 | 3/1988 | Kogure . | |
| 4,736,612 | 4/1988 | Russell . | |
| 4,790,173 | 12/1988 | Boutcher, Jr. | 72/481.1 |
| 5,009,098 | 4/1991 | Van Merksteijn . | |
| 5,103,665 | 4/1992 | Van Merksteijn | 72/446 |
| 5,121,626 | 6/1992 | Baldwin . | |
| 5,305,659 | 4/1994 | Dieperink et al. . | |
| 5,443,549 | 8/1995 | Mimuro et al. | 72/441 |
| 5,479,809 | 1/1996 | Stachuletz et al. . | |
| 5,619,885 | 4/1997 | Kawano et al. | 72/481.1 |

FOREIGN PATENT DOCUMENTS

| | | | |
|---|---|---|---|
| 1420380 | 11/1965 | France | 72/389.5 |

*Primary Examiner*—David Jones
*Attorney, Agent, or Firm*—Eugene Stephens & Associates

[57] ABSTRACT

Mating sets of forming punches and dies having different combined working heights are mounted at multiple work stations in a single press brake by means of a variable height forming punch holder. The punch holder has a pair of mating step wedges that are adjustable to increase a working height of a mounted forming punch so that each mating set of forming punches and dies has an equal combined working height. This avoids custom tooling while allowing a sequence of forming operations to occur at multiple work stations without driving tools into contact with each other.

25 Claims, 6 Drawing Sheets

TOOL WORKING HEIGHT ADJUSTMENT FOR PRESS BRAKE

TECHNICAL FIELD

Mounting of tools in press brakes.

BACKGROUND

Commonly available punch and die tools for press brakes are made with variable working heights so that combined working heights of mating punch and die sets often differ. Even though such tools may be in stock and available for use, sets of tools with different combined working heights cannot be arranged at different work stations along the length of a press brake. This is a serious disadvantage. Press brakes have grown larger and longer and are readily able to accommodate multiple work stations along their length, so long as the combined working height of all the mating tool sets is equal. Such multiple work stations are often desirable so that all the forming operations required for a single work piece can be performed sequentially at different work stations of a press brake. This allows all the necessary forming operations to be completed while the work piece is being handled once, which can make production much more efficient.

If all the punch and die tool sets mounted in a press brake have a common or equal combined working height, then each working stroke of the ram of the press brake can bring the tools at each work station into working juxtaposition without crashing tools together. A possible solution that has been used for mounting of punch and die tools at multiple work stations along a press brake is to have tools custom made to achieve equal combined working heights for each tool set. This solution has two serious disadvantages, though. Custom made forming punches or dies for a press brake cost much more than ordinary tools, which may even be available from an established stock. Secondly, custom tooling involves delay while tools are made to the required working height, and the delay slows down production. Both of these problems increase tool costs and add to production expense.

This invention solves the problem of mounting multi-work station press brake tooling having different combined working heights so as to avoid the need for custom made tooling. The invention applies its solution to a European-style press brake having tool holders for mounting forming punches on a ram of the press brake to move into working juxtaposition with dies mounted on a bed of the press brake. An example of such a press brake is shown in U.S. Pat. No. 5,619,885.

SUMMARY OF THE INVENTION

I have devised an adjustable height tool holder that can be used in place of a standard tool holder for holding a forming punch on a ram of a press brake. My adjustable height tool holder allows forming punches to be mounted at increased working heights from the press brake ram so that equal combined working heights of forming punches and dies can be established for each mating tool set mounted in a press brake. Then, the working stroke of the ram of the press brake can be adjusted to bring each mating tool set into working juxtaposition without driving any of the tools into contact with each other. A succession of working strokes can then accomplish forming operations at each of the work stations set up in a press brake to maximize working capability and efficiency.

My variable height tool holder accomplishes this with available tools, which can eliminate the delay and expense of custom tooling. An investment in my adjustable height tool holder thus makes a press brake more versatile in allowing use of existing or commonly available forming punches and dies having different combined working heights. Being able to set up such tooling in a press brake with the aid of my variable height tool holder increases productivity and reduces the expense of many forming operations.

DRAWINGS

FIG. 1 is a schematic view of a press brake illustrating the problem of different combined working heights of commonly available forming punch and die tooling.

FIG. 2 schematically illustrates a press brake similar to the one shown in FIG. 1 with my adjustable height tool holders arranged for giving all the mating tool sets an equal combined working height.

DETAILED DESCRIPTION

Figure 1:
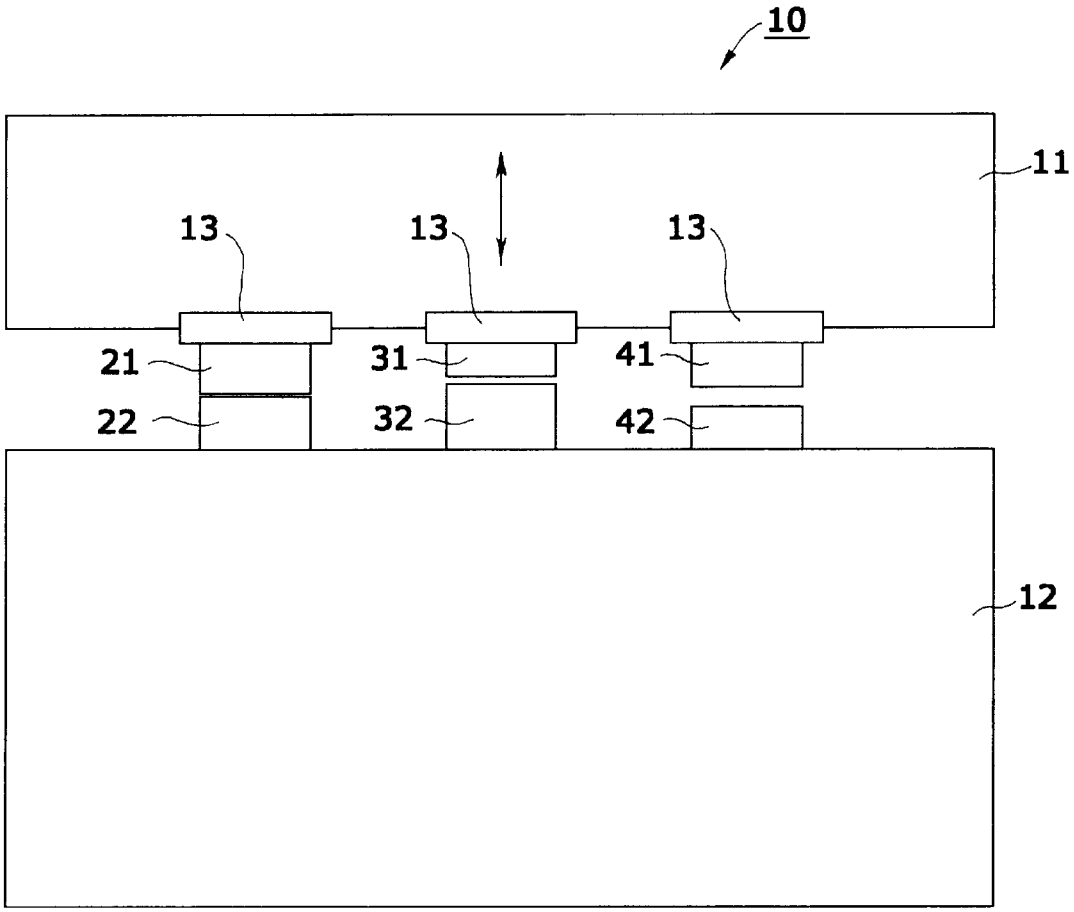

FIG. 1 schematically shows a press brake 10 with a ram 11 and a bed 12 and illustrates the problem of attempting to mount mating sets of forming punches and dies having different combined working heights. Standard tool holders 13 mount forming punches on ram 11, and bed 12 supports respectively mating dies. When the combined working heights of mating sets of punches and dies are different, as illustrated in FIG. 1, the tools cannot all be brought into working juxtaposition with a working stroke of ram 11.

For example, forming punch 21 and a mating die 22 have a combined working height that is larger than the combined working heights of forming punch 31 and its mating die 32 or forming punch 41 and its mating die 42. Tooling sets 21, 22; 31, 32; and 41, 42 are commonly available in non-standard working heights so that the problem illustrated in FIG. 1 often occurs. If a working stroke of ram 11 is increased from the position illustrated in FIG. 1 to bring tools 31 and 32 or 41 and 42 into working juxtaposition, then taller tools 21 and 22 will crash into each other.

The way this problem has been solved is to either reduce the number of work stations set up in press brake 10 or to order custom tooling having the required working heights so that the combined working height of each mating set of forming punches and dies is equal. Either solution has costly disadvantages. Reducing the number of work stations makes press brake 10 less versatile and increases production costs. Ordering custom tooling involves some delay and a significant increase in tooling expense. Also, shops that operate press brakes typically have an invested inventory of conventional tooling that could be used for multiple work stations in press brake 10, if the mating tool sets happened to have the correct combined working height. Unfortunately, conventional tooling rarely meets this requirement.

Figure 2:
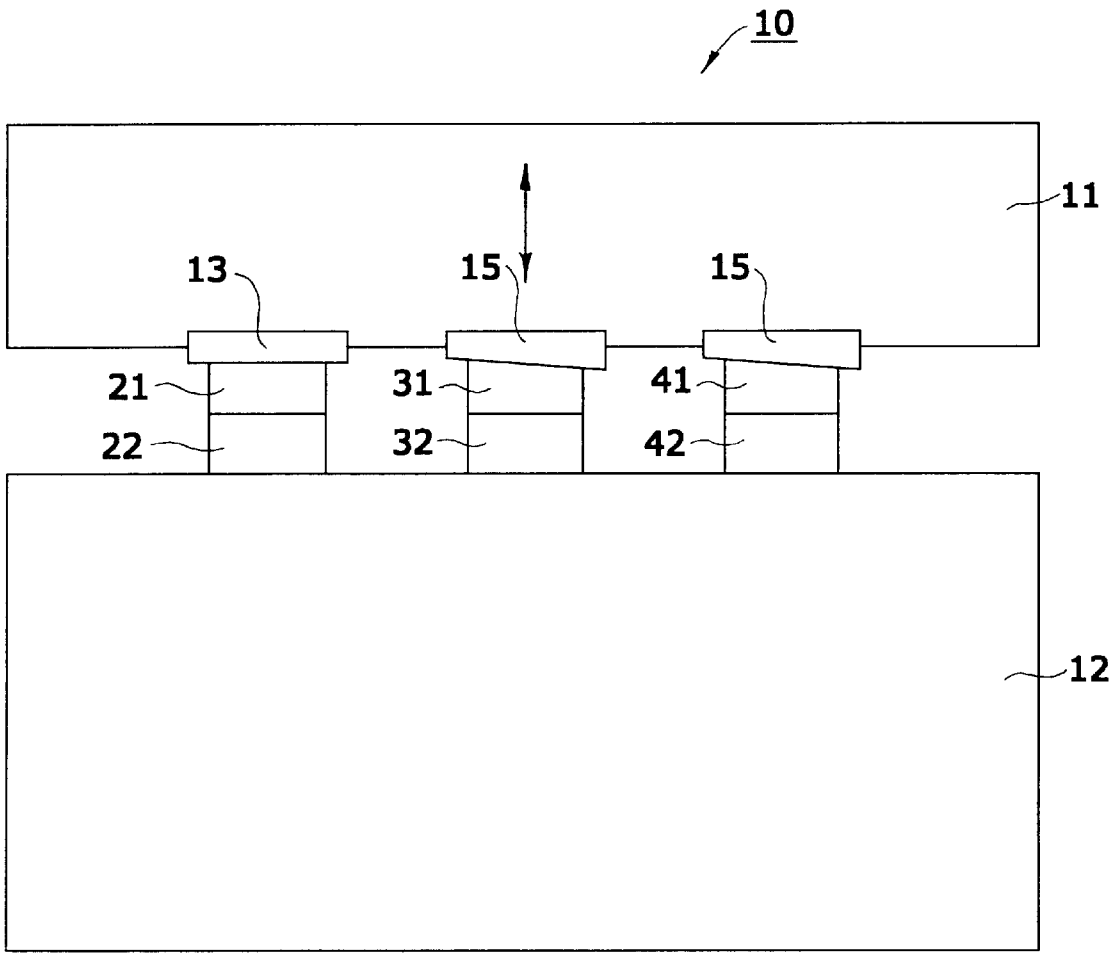

FIG. 2 schematically shows use of my variable height punch holder 15 to vary the working heights of punches 31 and 41 so that all the mating tool sets mounted in press brake 10 have an equal combined working height. The mating tool set with the largest combined working height can have punch 21 mounted in conventional tool holder 13. The other mating tool sets, which need increased combined working heights, have their punches 31 and 41 mounted in variable height tool holders 15, which are substituted for conventional tool holders 13. By separate adjustment of each variable height tool holder 15, punches 31 and 41 are set at increased working heights that make the combined working heights of each mounted tool set equal. A single working stroke of ram 11 then moves each mating tool set into working juxtaposition as illustrated in FIG. 2 so that forming operations can be accomplished sequentially at each work station arranged along the length of press brake 10.

Figure 3:
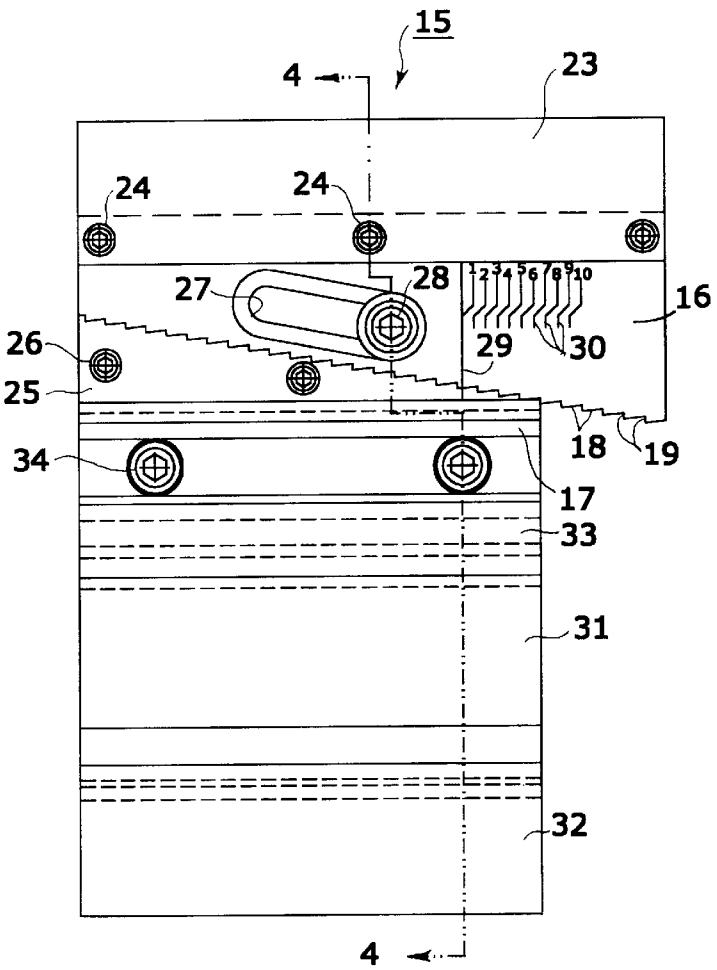
FIG. 3 is an elevational view of a preferred embodiment of my variable height tool holder supporting a forming punch in mating juxtaposition with a die to increase by a small amount a combined working height of the mounted tooling.
Figure 5:
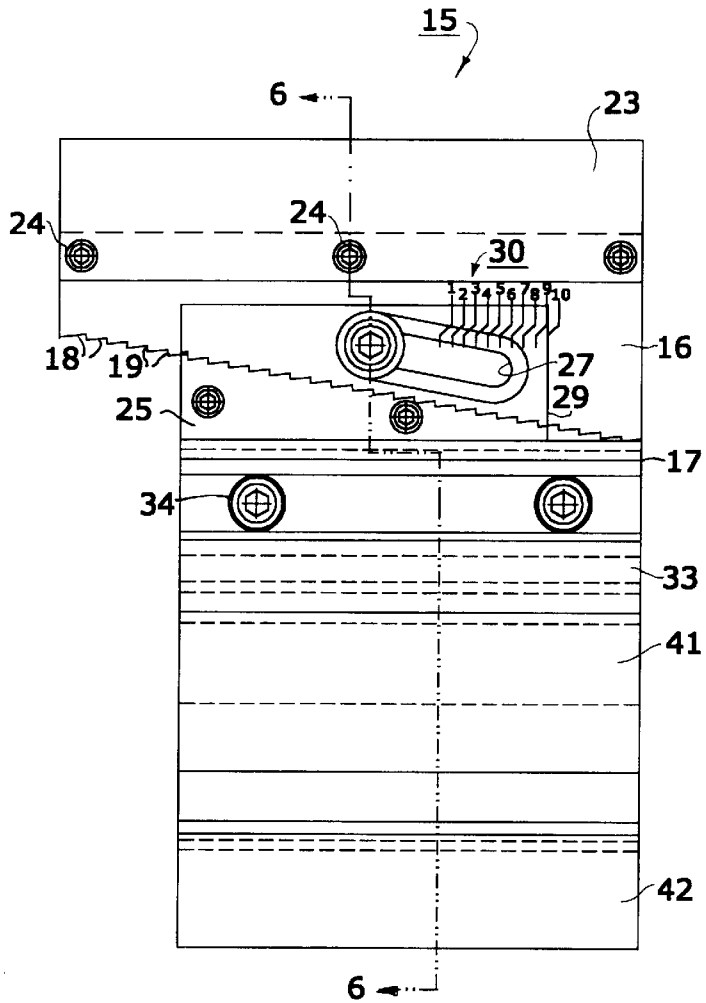
FIG. 5 is an elevational view of my variable height tool holder supporting another forming punch in mating juxtaposition with another die to increase by a larger amount a combined working height of the mounted tooling.
Figure 7:
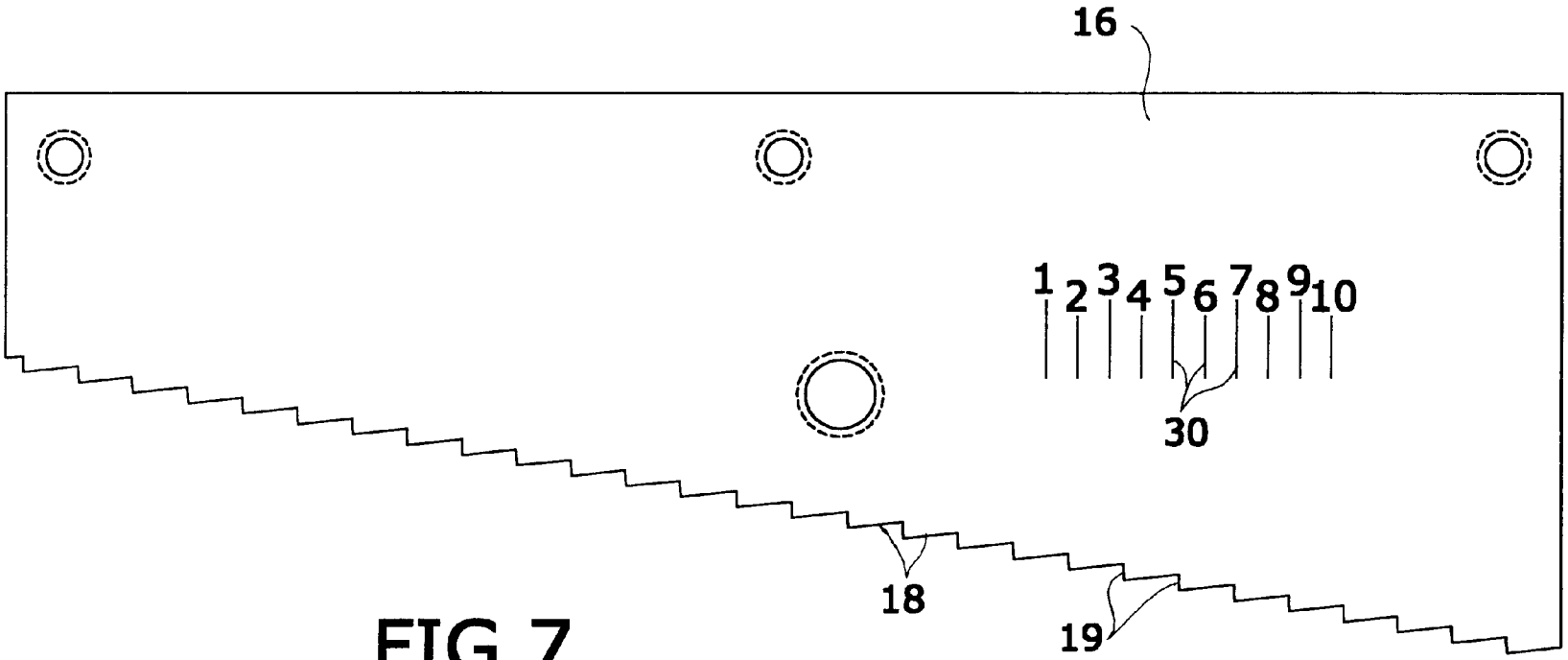
FIG. 7 is an enlarged view of a preferred embodiment of step wedge used in my adjustable height tool holder.

My forming punch holder 15 achieves variable height preferably by means of a pair of mating step wedges 16 and 17 that are laterally adjustable, as illustrated by the different positions of FIGS. 3 and 5. I prefer that wedges 16 and 17 have stepped surfaces along their incline of interengagement so that when downward pressure is applied to tool holder 15, no slippage out of adjustment will occur. I also prefer that the rise 19 and run 18 of the corresponding steps of the mating surfaces of wedges 16 and 17 be inclined respectively from vertical and horizontal so that corresponding steps of each wedge tend to slide into interlocked engagement when pressure is applied to tool holder 15.

A mounting plate 23 is secured to step wedge 16, preferably by screws 24; and mounting plate 23 is secured to the ram of a press brake by means of a conventional mounting clamp (not shown). This arrangement allows stepped wedge 16 to be made in several different working heights that can be interchanged with one another.

Stepped wedge 17, which corresponds with wedge 16, has a mounting plate 25 secured by screws 26. Plate 25 has an elongated slot 27 through which a screw 28 extends into wedge 16. Loosening screw 28 allows wedge 17 to be moved step-wise along the length of wedge 16 and secured in any desired position along the adjustment length by tightening screw 28. In any such position, a full stepped length of wedge 17 preferably engages a stepped surface of wedge 16 to transmit downward pressure accurately. Forming punch 31 is secured to wedge 17 by a standard clamping plate 33 held by screws 34. Clamping plate 33 and screws 34 preferably have the same form as standard clamping plates and screws that secure plate 23 to the ram of a press brake.

Wedge 16 of variable height tool holder 15 is preferably dimensioned so that a minimum working height adjustment position, as shown in FIG. 3, slightly exceeds a working height position of a standard tool holder 13. Substituting variable height forming punch holder 15 for a standard punch holder 13 then slightly increases a working height of a mounted punch, even at a minimum height adjustment. Changing the adjustment position between wedges 16 and 17 then increases the working height even further.

I prefer that each of the adjustment steps of wedges 16 and 17 adds about 0.030 inches to working tool height and that the minimum height adjustment position shown in FIG. 3 adds about 0.030 inches above the working height of a standard punch holder 13. Adjustment increments of about 0.030 inches can bring each set up to within ±0.015 inches, which is generally satisfactory for most press brake applications. Finer adjustments can be made if necessary by changing the height of rises 19.

The arrangement illustrated in FIGS. 3–6 allows an overall working height adjustment of about 0.250 inches from the minimum shown in FIG. 3 to the maximum shown in FIG. 5. Substituting a taller wedge for wedge 16 can increase the height-adjusting range through another 0.250 inches. Also, taller substitutes can be made for mating wedge 17 so that substituting a few simple parts can achieve large variations in working tool height adjustment with my tool holder.

Further variation in combined working tool height can be accomplished with conventional bolsters mounted on a press brake bed to increase a working height of a die. Such bolsters are commonly available and can be combined with my variable height tool holder 15.

Figure 4:
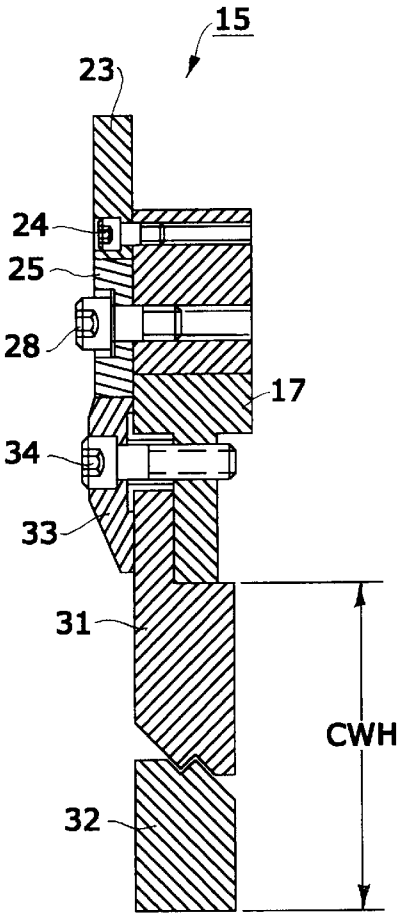
FIG. 4 is a cross-sectional view of the variable height tool holder, forming punch, and die of FIG. 3, taken along the line 4—4 thereof.
Figure 6:
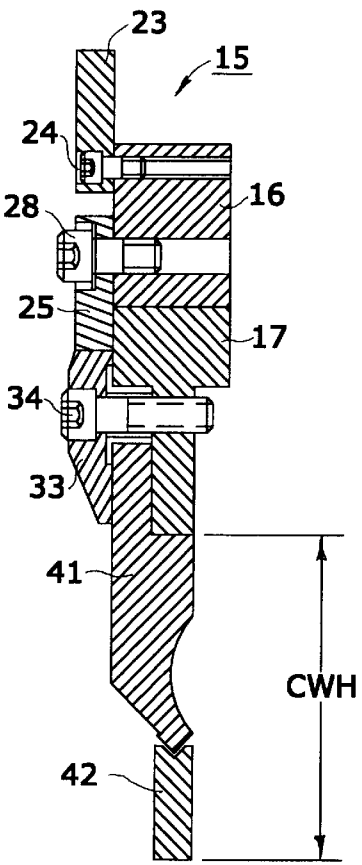
FIG. 6 is a cross-sectional view of the variable height tool holder, forming punch, and die of FIG. 5, taken along the line 6—6 thereof.

A larger working height adjustment of tool holder 15, illustrated in FIG. 5 as a maximum height adjustment, is applied to punch 41, mating with die 42, since these have the smallest combined working height, as illustrated in FIG. 1. Punch 31 and die 32, having a medium combined working height, use a smaller working height adjustment, illustrated in FIG. 3 as a minimum height adjustment, to add a small increment of working height beyond what is achievable with standard tool holder 13. Combined working height (CWH) for tool sets 31, 32 and 41, 42 is illustrated in FIGS. 4 and 6.

After mating sets of forming punches and dies are properly adjusted by means of tool holder 15 to be set at equal combined working heights, a stroke of a press brake can then be adjusted to bring punch and die tools at each work station into working juxtaposition without crashing any tools into each other. The level at which each mating set of tools meets can differ from one work station to another; and the actual working stroke of the press brake ram can vary slightly during sequential operations, depending on whether air forming or coining is occurring and depending on the pressure applied for each operation. All this can occur without any conflicting interengagement between mating tool sets, though, once the combined working heights of each tool set is made equal by adjustment of tool holder 15. Equality of combined working tool heights for this purpose is approximate or close enough to equal so that forming operations can be carried out without crashing tools into each other.

Mounting block 25 secured to wedge 17 preferably has an edge 29 that registers with a scale 30 formed on wedge 16. This allows direct reading of a height adjustment between mating steps of wedges 16 and 17.

Figure 8:
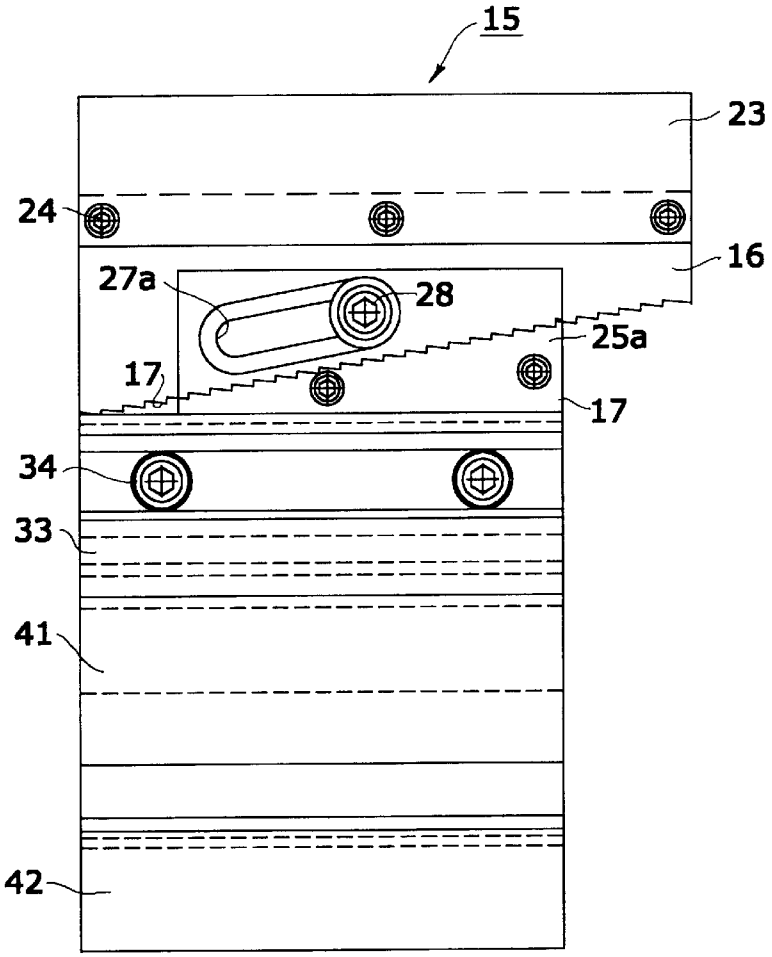
FIG. 8 is an elevational view of an alternative support plate allowing reversal of an adjustment direction of my variable height tool holder.

The inclination of the mating stepped surfaces of wedges 16 and 17 can be reversed to change the direction of an increase in working height. This can prevent interference in set-up situations involving multiple work stations close to each other. This change can be made by reversing the mounting of wedge 16 on its mounting plate 23 and by similarly reversing wedge 17, which then requires a substitute mounting plate 25*a*, as shown in FIG. 8. This is necessary to keep mounting plate 25*a* forward of wedge 17 on the front side of the press brake and to provide adjustment slot 27*a* oriented at the angle of the reversed wedges.

Variable height tool holder 15 is preferably made with dimensions similar to conventional tool holder 13 so that variable height tool holder 15 can be readily substituted for any conventional tool holder 13. This helps increase versatility and simplifies tooling set-up.

I claim:

1. A method of mounting a plurality of mating tool sets of forming punches and dies to be used in a set-up of different work stations along a press brake, the mating tool sets having different combined working heights, and the method comprising:

a. selecting from the mating tool sets a reference mating tool set having a combined working height larger than any other mating tool set;

b. mounting the reference mating tool set at a reference work station;

c. adjusting a working height of a punch holder by positioning a mating pair of stepped wedges; and d. using the punch holder to mount a punch of another mating tool set at another work station with the holder adjusted to add sufficient working punch height to bring the combined working height of the other mating tool set into equality with the reference mating tool set.

2. The method of claim 1 including adjusting a working stroke of the press brake so that mating tool sets move into working juxtaposition simultaneously at each work station without moving the mating tool sets into contact.

3. A method of arranging forming punches and dies at multiple work stations along a press brake, the method comprising:

a. using mating tool sets of the forming punches and dies having different combined working heights that would cause tooling interference if mounted directly in the press brake;

b. achieving compatible working heights for the mating tool sets having different combined working heights by mounting at least one of the forming punches in an adjustable height tool holder; and c. adjusting the tool holder by positioning a mating pair of stepped wedges to vary punch working height by an amount that brings combined working heights of the mating tool sets into equality.

4. The method of claim 3 including mounting the adjustable tool holder on a ram of the press brake.

5. The method of claim 3 including selecting a working tool set whose punch is mounted with the adjustable tool holder to increase a shorter combined working height than another mating tool set mounted directly in the press brake without using the adjustable tool holder.

6. The method of claim 3 including adjusting a working stroke of the press brake to bring each of the mating tool sets simultaneously into working juxtaposition without interengagement between any of the mating tool sets.

7. A press brake having mating tool sets of forming punches and dies arranged at a plurality of work stations in a combination comprising:

a. the mating tool sets having unequal combined working heights;

b. tool holders mounting punches of the mating tool sets so as to dispose the punches at different working heights from a ram of the press brake;

c. the tool holders including an adjustable tool holder having a pair of mating stepped wedges arranged for adding variable amounts of working height to a mounted punch; and d. the different working heights of the punches being adjusted by the tool holder to bring the combined working heights of the mounted tool sets into equality.

8. The combination of claim 7 wherein the wedges are adjustable step-wise for incrementally varying working height of a mounted punch.

9. The combination of claim 7 wherein the wedges are adjustable longitudinally of the press brake.

10. The combination of claim 9 wherein a direction of adjustment of the wedges for height increase is reversible.

11. The combination of claim 7 wherein one of the wedges is interchangeable with a similar wedge having a different height adjustment range.

12. The combination of claim 7 wherein rise and run surfaces of steps of the wedges are inclined respectively from vertical and horizontal.

13. In a press brake of the type using tool holders secured to a ram of the press brake to hold forming punches at a predetermined mounting height, the improvement comprising:

a. an adjustable punch holder securable to the ram in place of a tool holder;

b. the adjustable punch holder being adjustable vertically to alter a mounting height of a punch held in the adjustable punch holder; and c. the adjustable punch holder having a mating pair of stepped wedges that incrementally increases a punch mounting height by engagement of different respective steps of the wedges.

14. The improvement of claim 13 wherein the stepped wedges are adjustable longitudinally of the press brake.

15. The improvement of claim 14 including a mounting plate holding one of the wedges being interchangeable to allow reversal of an adjustment direction for increasing punch mounting height.

16. The improvement of claim 13 wherein the adjustable punch holder has sufficient range of punch mounting height adjustment to provide equal combined working heights for mating sets of punches and dies having unequal combined working heights.

17. The improvement of claim 16 wherein at least one of the wedges is interchangeable with a wedge affording a different range of mounting height adjustment.

18. The improvement of claim 13 wherein rise and run surfaces of the stepped wedges are angled respectively from vertical and horizontal.

19. A press brake having mating tool sets of different combined working heights mounted at different work stations within the press brake in a combination comprising:

a. a tool holder holding a punch of a mating tool set having a larger combined working height;

b. an adjustable height tool holder holding a punch of a mating tool set having a lesser combined working height;

c. the adjustable tool holder having a mating pair of step wedges that incrementally increase punch mounting height by selective interengagement of wedge steps; and d. the adjustable height tool holder being adjusted to add sufficient punch mounting height to make the lesser combined working height equal to the larger combined working height.

20. The combination of claim 19 wherein the adjustable tool holder secures to a ram of the press brake.

21. The combination of claim 19 wherein the wedges are adjustable longitudinally of the press brake.

22. The combination of claim 21 including an interchangeable wedge mounting plate allowing reversal of a direction of wedge adjustment for increasing punch height.

23. The combination of claim 19 wherein at least one of the wedges is interchangeable to afford different ranges of punch height adjustment.

24. The combination of claim 19 wherein rise and run surfaces of the wedges are inclined respectively from vertical and horizontal.

25. The combination of claim 19 wherein the press brake is adjusted for a working stroke that brings the mating tool sets into working juxtaposition simultaneously at each work station without interengaging any of the mating tool sets.

* * * * *